US010607769B2

(12) United States Patent
Jeong

(10) Patent No.: US 10,607,769 B2
(45) Date of Patent: Mar. 31, 2020

(54) ELECTRONIC COMPONENT INCLUDING A SPACER PART

(71) Applicant: SAMSUNG ELECTRO-MECHANICS CO., LTD., Suwon-si, Gyeonggi-do (KR)

(72) Inventor: Dong Jin Jeong, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/152,913

(22) Filed: Oct. 5, 2018

(65) Prior Publication Data

US 2019/0043659 A1 Feb. 7, 2019

Related U.S. Application Data

(63) Continuation of application No. 14/940,092, filed on Nov. 12, 2015.

(30) Foreign Application Priority Data

Jan. 28, 2015 (KR) ..... 10-2015-0013339

(51) Int. Cl.
*H01F 27/34* (2006.01)
*H01F 27/36* (2006.01)
(Continued)

(52) U.S. Cl.
CPC ..... *H01F 27/292* (2013.01); *H01F 17/0013* (2013.01); *H01F 17/04* (2013.01); *H01F 2017/048* (2013.01)

(58) Field of Classification Search
CPC ..... H01F 27/34; H01F 27/365; H01F 27/346; H01F 27/36
See application file for complete search history.

(56) References Cited

U.S. PATENT DOCUMENTS 6,294,976 B1 9/2001 Imada et al.
6,998,951 B2 2/2006 Itou et al.
(Continued)

FOREIGN PATENT DOCUMENTS

CN 1434468 A 8/2003
CN 101276669 A 10/2008
(Continued)

OTHER PUBLICATIONS

U.S. Final Office Action dated Jul. 27, 2018 issued in U.S. Appl. No. 14/940,092.
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

An electronic component includes a magnetic body, and first and second internal coil parts embedded in the magnetic body spaced apart from each other and including coil conductors disposed on first and second surfaces of a support member. First and second spacer parts are disposed between the first and second internal coil parts in upper and lower portions of the magnetic body, respectively, with an interval therebetween.

8 Claims, 6 Drawing Sheets

(51) Int. Cl.

| | |
|---|---|
| ***H01F 27/29*** | (2006.01) |
| ***H01F 17/00*** | (2006.01) |
| ***H01F 17/04*** | (2006.01) |

(56) References Cited

U.S. PATENT DOCUMENTS

| | | | | |
|---|---|---|---|---|
| 7,714,690 | B2 | 5/2010 | Shoji et al. | |
| 2001/0030593 | A1* | 10/2001 | Imada | H01F 17/0013 336/200 |
| 2003/0137384 | A1 | 7/2003 | Itou et al. | |
| 2005/0012581 | A1* | 1/2005 | Ono | H01F 1/1475 336/90 |
| 2006/0268457 | A1* | 11/2006 | Sano | H01F 3/12 360/125.01 |
| 2008/0179445 | A1* | 7/2008 | Shoji | H01F 3/10 242/570 |
| 2013/0249664 | A1* | 9/2013 | Tonoyama | H01F 41/04 336/200 |
| 2014/0266546 | A1* | 9/2014 | Mao | H01F 27/2804 336/200 |
| 2015/0002256 | A1* | 1/2015 | Bourns | H01F 27/2804 336/84 M |

FOREIGN PATENT DOCUMENTS

| | | | | | |
|---|---|---|---|---|---|
| JP | H06-176928 | A | | 6/1994 | |
| JP | H06176928 | A | * | 6/1994 | H01F 17/00 |
| JP | H10-270256 | A | | 10/1998 | |
| JP | H10270256 | A | * | 10/1998 | H01F 17/00 |
| JP | 11040459 | A | * | 2/1999 | H01G 4/38 |
| JP | H11-040459 | A | | 2/1999 | |
| JP | 2000-299227 | A | | 10/2000 | |
| JP | 2001-118728 | A | | 4/2001 | |
| JP | 2001118728 | A | * | 4/2001 | H01F 17/00 |
| KR | 10-1999-013544 | A | | 2/1999 | |
| KR | 10-2005-0011090 | A | | 1/2005 | |
| KR | 10-0533767 | B1 | | 12/2005 | |

OTHER PUBLICATIONS

U.S. Non-Final Office Action dated Dec. 28, 2017 issued in U.S. Appl. No. 14/940,092.

Chinese Office Action dated Apr. 1, 2017 issued in Chinese Patent Application No. 201510847253.7 (with English translation).

U.S. Non-Final Office Action dated Sep. 15, 2016 issued in U.S. Appl. No. 14/940,092.

Office Action issued in corresponding Korean Patent Application No. 10-2015-0013339 dated Aug. 21, 2019, with English translation.

* cited by examiner

ELECTRONIC COMPONENT INCLUDING A SPACER PART

CROSS-REFERENCE TO RELATED APPLICATION

This application is a continuation patent application of U.S. patent application Ser. No. 14/940,092, filed on Nov. 12, 2015 which claims the priority and benefit of Korean Patent Application No. 10-2015-0013339, filed on Jan. 28, 2015 with the Korean Intellectual Property Office, the entireties of which are incorporated herein by reference.

BACKGROUND

The present disclosure relates to an electronic component and a board having the same.

An inductor, an electronic component, is a representative passive element configuring an electronic circuit, together with a resistor and a capacitor, to remove noise therefrom.

In order to decrease an area required for the mounting of passive elements on a printed circuit board, an array-type inductor in which a plurality of internal coil parts are disposed may be used.

SUMMARY

An aspect of the present disclosure provides an electronic component capable of suppressing harmful mutual interference of magnetic fields generated by a plurality of internal coil parts disposed in the electronic component, and a board having the same.

According to an aspect of the present disclosure, an electronic component comprises a magnetic body, and first and second internal coil parts embedded in the magnetic body spaced apart from each other and including coil conductors disposed on first and second surfaces of a support member. First and second spacer parts are disposed between the first and second internal coil parts in upper and lower portions of the magnetic body, respectively, with an interval therebetween.

The first and second spacer parts may contain at least one selected from the group consisting of a thermosetting resin, magnetic metal powder, ferrite, and a dielectric material.

The first and second spacer parts may be formed of a material different from a material of the magnetic body.

The first and second spacer parts may be extended from a first side surface of the magnetic body to a second side surface thereof in a width direction of the magnetic body.

The interval "a" between the first and second spacer parts may satisfy 0 μm<a<1000 μm.

A space between the first and second spacer parts may include a material which is the same as a material of the magnetic body.

The magnetic body may contain a magnetic metal powder and a thermosetting resin.

The coil conductors may be electroplated layers.

The first and second internal coil parts may include first and second lead portions exposed to first and second side surfaces of the magnetic body, respectively, the first lead portions may be connected to first and second external electrodes disposed on the first side surface of the magnetic body, and the second lead portions may be connected to third and fourth external electrodes disposed on the second side surface of the magnetic body.

The first and second external electrodes may be input terminals, and the third and fourth external electrodes may be output terminals.

According to another aspect of the present disclosure, an electronic component comprises a magnetic body, and first and second internal coil parts embedded in the magnetic body spaced apart from each other and including coil conductors disposed on first and second surfaces of a support member. A spacer part is disposed between the first and second internal coil parts and suppressing mutual interference of magnetic fields generated by the first and second internal coil parts.

The spacer part may include first and second spacer parts disposed in upper and lower portions of the magnetic body, respectively, with a predetermined interval therebetween.

The spacer part may have a magnetic permeability lower than that of the magnetic body.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
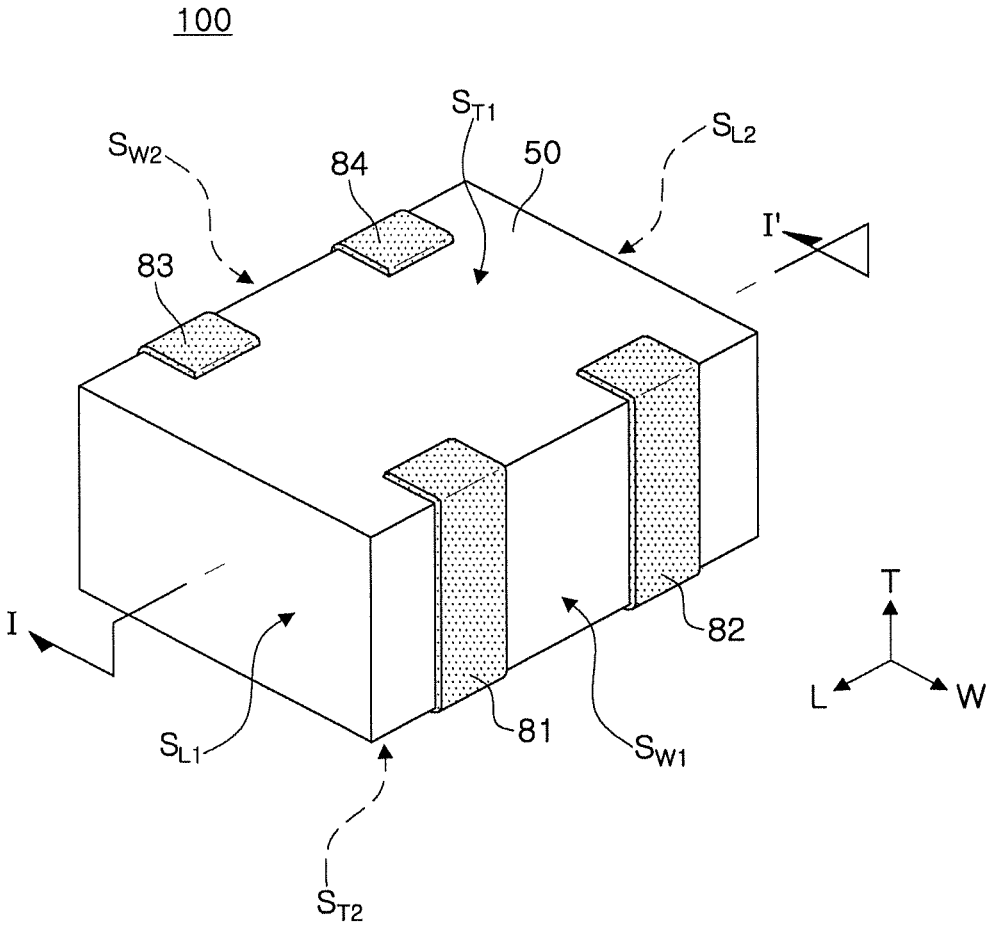
FIG. 1 is a perspective view of an electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Electronic Component

Hereinafter, an electronic component, according to an exemplary embodiment, particularly, a thin film type inductor, will be described. However, the electronic component is not limited thereto.

Figure 2:
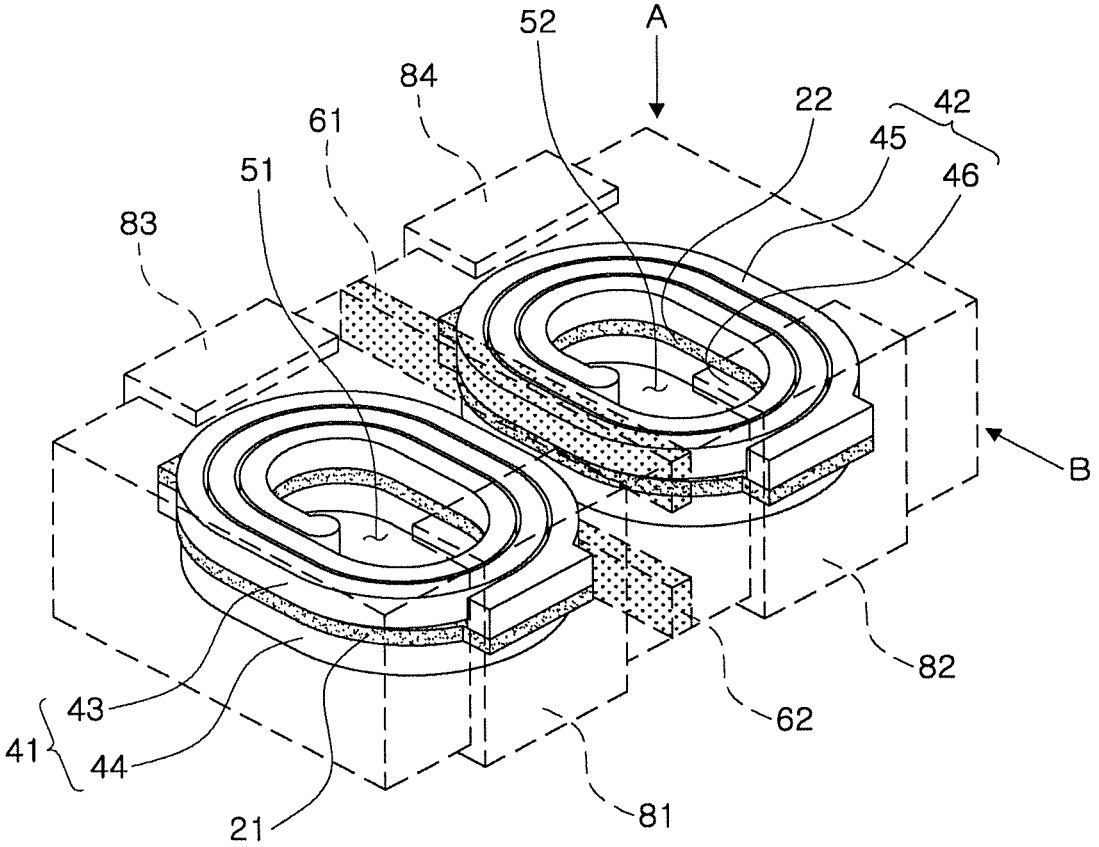
FIG. 2 is a perspective view of internal coil parts in the electronic component according to the exemplary embodiment in the present disclosure.

FIG. 1 is a perspective view of an electronic component according to an exemplary embodiment in the present disclosure, and FIG. 2 is a perspective view of internal coil parts in the electronic component.

Referring to FIGS. 1 and 2, as an example of the electronic component, a thin film type inductor used for a power line of a power supply circuit is disclosed.

An electronic component 100 according to the exemplary embodiment may include a magnetic body 50, first and second internal coil parts 41 and 42 embedded in the magnetic body 50, first and second spacer parts 61 and 62 disposed between the first and second internal coil parts 41 and 42, and first to fourth external electrodes 81, 82, 83, and 84 disposed on external surfaces of the magnetic body 50.

In the exemplary embodiment in the present disclosure, ordinal numbers such as "first and second", "first to fourth", and the like, are used in order to distinguish objects, and are not limited to the order thereof.

In the electronic component 100 according to an exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may have first and second end surfaces $S_{L1}$ and $S_{L2}$ opposing each other in the length (L) direction, first and second side surfaces $S_{W1}$ and $S_{W2}$ connecting the first and second end surfaces $S_{L1}$ and $S_{L2}$ to each other and opposing each other in the width (W) direction, and first and second main surfaces $S_{T1}$ and $S_{T2}$ opposing each other in the thickness (T) direction.

The magnetic body 50 may contain any material as long as the material exhibits magnetic properties. For example, the magnetic body 50 may contain ferrite or a magnetic metal powder.

The ferrite may be, for example, an Mn—Zn based ferrite, an Ni—Zn based ferrite, an Ni—Zn—Cu based ferrite, an Mn—Mg based ferrite, a Ba based ferrite, or an Li based ferrite.

The magnetic metal powder may be a crystalline or amorphous metal powder containing one or more selected from the group consisting of iron (Fe), silicon (Si), boron (B), chromium (Cr), aluminum (Al), copper (Cu), niobium (Nb), and nickel (Ni).

For example, the magnetic metal powder may be an Fe—Si—B—Cr based amorphous metal powder.

The magnetic metal powder may be dispersed in a thermosetting resin such as an epoxy resin or a polyimide to thereby be contained in the magnetic body 50.

The magnetic body 50 may include the first and second internal coil parts 41 and 42, disposed to be spaced apart from each other.

That is, the electronic component 100 according to the exemplary embodiment may be an array-type inductor having a basic structure in which two or more internal coil parts are disposed.

The first and second internal coil parts 41 and 42 may be formed by connecting first coil conductors 43 and 45 formed on first surfaces of first and second support members 21 and 22 disposed to be spaced apart from each other in the magnetic body 50 to second coil conductors 44 and 46 formed on second surfaces of the first and second support members 21 and 22 opposing the one surfaces thereof, respectively.

The first and second coil conductors 43 to 46 may have the form of planar coils formed on the same planes of the first and second support members 21 and 22, respectively.

The first and second coil conductors 43 to 46 may have a spiral shape, the first and second coil conductors 43 and 44 formed on the first and second surfaces of the first support member 21 may be electrically connected to each other by a via (not illustrated) penetrating through the first support member 21, and the first and second coil conductors 45 and 46 formed on the first and second surfaces of the second support member 22 may be electrically connected to each other by a via (not illustrated) penetrating through the second support member 22.

The first and second coil conductors 43 to 46 may be formed by performing electroplating on the support members 21 and 22, but a method of forming the first and second coil conductors 43 to 46 is not limited thereto.

The first and second coil conductors 43 to 46 and the vias may be formed of a metal having excellent electric conductivity, for example, silver (Ag), palladium (Pd), aluminum (Al), nickel (Ni), titanium (Ti), gold (Au), copper (Cu), platinum (Pt), or alloys thereof.

The first and second coil conductors 43 to 46 may be coated with an insulation film (not illustrated) to thereby not directly contact the magnetic material forming the magnetic body 50.

The first and second internal coil parts 41 and 42 may be disposed to be symmetrical to each other in relation to a central portion of the magnetic body 50 in the length (L) direction.

The first and second support members 21 and 22 may be, for example, a polypropylene glycol (PPG) substrate, a ferrite substrate, or a metal-based soft magnetic substrate.

The first and second support members 21 and 22 may have through holes penetrating through central portions thereof, wherein the through holes are filled with a magnetic material, thereby forming first and second core parts 51 and 52. That is, the first and second core parts 51 and 52 may be formed inwardly of the first and second internal coil parts 41 and 42, respectively.

As the first and second core parts 51 and 52 formed of the magnetic material are formed inwardly of the first and second internal coil parts 41 and 42, inductance L may be improved.

The first and second internal coil parts 41 and 42 may be disposed to be spaced apart from each other by a predetermined interval in the length (L) direction of the magnetic body, and the first and second spacer parts 61 and 62 may be disposed between the first and second internal coil parts 41 and 42.

The first and second spacer parts 61 and 62 may be disposed in upper and lower portions of the magnetic body 50 in the thickness (T) direction, respectively, with a predetermined interval therebetween.

According to the exemplary embodiment, the spacer parts 61 and 62 may be disposed between the first and second internal coil parts 41 and 42, such that harmful mutual interference of the magnetic fields generated by the plurality of internal coil parts may be suppressed.

In a case of an array-type electronic component in which a plurality of internal coil parts are disposed, malfunctioning of a product may occur and efficiency may be deteriorated due to harmful interference between the internal coil parts.

As electronic components have been miniaturized, the interval between a plurality of internal coil parts embedded in the electronic component has been decreased, such that it may be difficult to suppress harmful interference between the internal coil parts through only adjusting shapes of the internal coil parts and positional relationships therebetween.

Therefore, according to the exemplary embodiment in the present disclosure, the first and second spacer parts 61 and 62 may be formed in the upper and lower portions of the magnetic body 50 in the thickness (T) direction, respectively, between the first and second internal coil parts 41 and 42, such that harmful mutual interference of the magnetic fields generated by the plurality of internal coil parts may be suppressed.

The first and second spacer parts 61 and 62 may be formed of any material as long as the material may suppress harmful mutual interference of the magnetic fields generated by the first and second internal coil parts 41 and 42. In addition, the first and second spacer parts 61 and 62 may be formed of a material different from that of the magnetic body 50.

The material different from that of the magnetic body 50 may also include a material in which the same raw material is contained but a composition thereof, or the like, is different.

For example, the first and second spacer parts 61 and 62 may contain one or more selected from the group consisting of a thermosetting resin, a magnetic metal powder, ferrite, and a dielectric material.

The first and second spacer parts 61 and 62 as described above may have magnetic permeability lower than that of the magnetic body 50, such that the first and second spacer parts 61 and 62 may suppress harmful mutual interference of the magnetic fields generated by the first and second internal coil parts 41 and 42.

The first and second internal coil parts 41 and 42 may be electrically connected to the first to fourth external electrodes 81 to 84 disposed on the external surfaces of the magnetic body 50.

The first to fourth external electrodes 81 to 84 may be formed on the first and second side surfaces $S_{W1}$ and $S_{W2}$ of the magnetic body 50 and extended to the first and second main surfaces $S_{T1}$ and $S_{T2}$ of the magnetic body 50 in the thickness (T) direction.

The first to fourth external electrodes 81 to 84 may be disposed to be spaced apart from each other to thereby be electrically separated from each other.

The first to fourth external electrodes 81 to 84 may be formed of a metal having excellent electrical conductivity, for example, silver (Ag), palladium (Pd), aluminum (Al), nickel (Ni), titanium (Ti), gold (Au), copper (Cu), platinum (Pt), or alloys thereof.

Figure 3A:
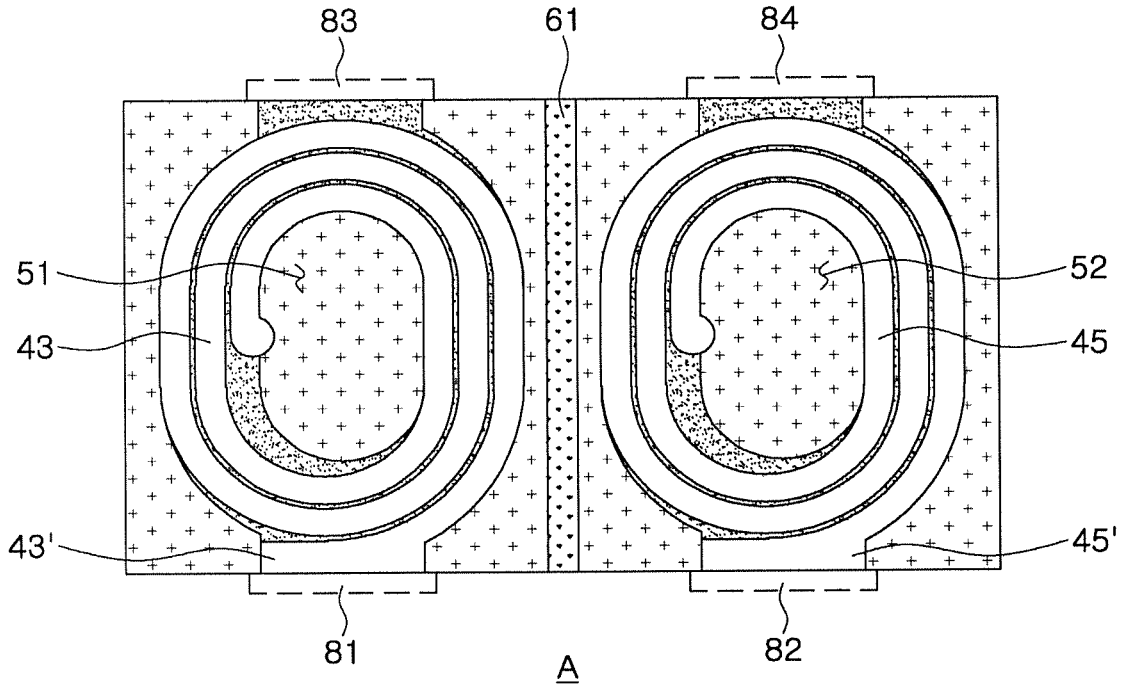
FIGS. 3A and 3B are plan views of an internal portion of the electronic component projected in directions A and B of FIG. 2, respectively.
Figure 3B:
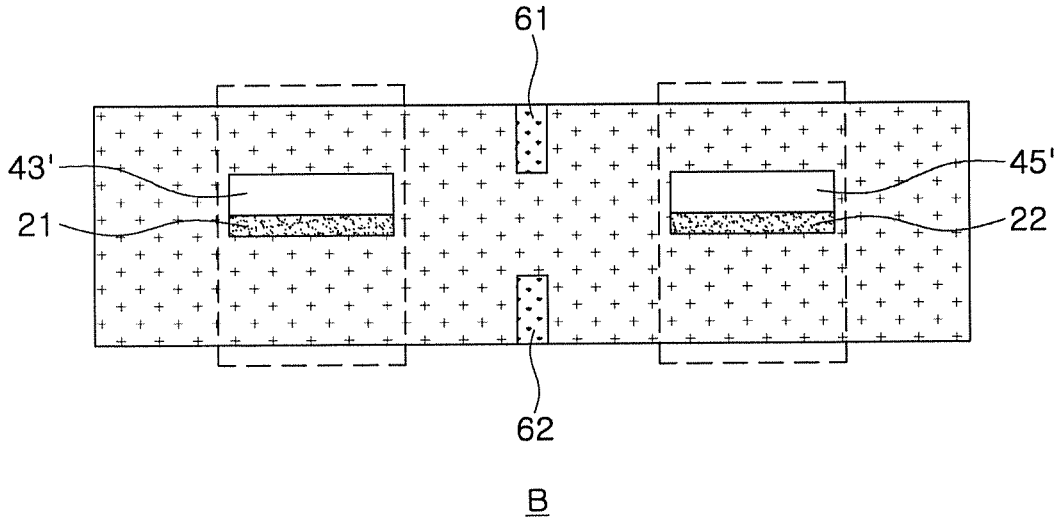

FIG. 3A is a plan view of an internal portion of the electronic component projected in direction A of FIG. 2, and FIG. 3B is a plan view of the internal portion of the electronic component projected in direction B of FIG. 2.

Referring to FIG. 3A, the first and second internal coil parts 41 and 42 may include first lead portions 43' and 45' extended from end portions of the first coil conductors 43 and 45 and exposed to the first side surface $S_{W1}$ of the magnetic body 50 and second lead portions (not illustrated) extended from end portions of the second coil conductors 44 and 46 and exposed to the second side surface $S_{W2}$ of the magnetic body 50.

The first lead portions 43' and 45' may be connected to the first and second external electrodes 81 and 82 disposed on the first side surface $S_{W1}$ of the magnetic body 50, and the second lead portions (not illustrated) may be connected to the third and fourth external electrodes 83 and 84 disposed on the second side surface $S_{W2}$ of the magnetic body 50.

The first and second external electrodes 81 and 82 may be input terminals, and the third and fourth external electrodes 83 and 84 may be output terminals, but the first to fourth external electrodes 81 to 84 are not limited thereto.

For example, a current input to the first external electrode 81, the input terminal, may sequentially pass through the first coil conductor 43 of the first internal coil part 41, the via, and the second coil conductor 44 of the first internal coil part 41 to thereby flow to the third external electrode 83, the output terminal.

Similarly, a current input to the second external electrode 82, the input terminal, may sequentially pass through the first coil conductor 45 of the second internal coil part 42, the via, and the second coil conductor 46 of the second internal coil part 42 to thereby flow to the fourth external electrode 84, the output terminal.

The first and second spacer parts 61 and 62 may be extended from the first side surface $S_{W1}$ of the magnetic body 50 to the second side surface $S_{W2}$ thereof in the width (W) direction. That is, the first and second spacer parts 61 and 62 may be formed to have a length equal to a width W of the magnetic body 50.

Referring to FIG. 3B, the first and second spacer parts 61 and 62 may be disposed in the upper and lower portions of the magnetic body 50 in the thickness (T) direction, respectively, with a predetermined interval therebetween.

The coupling value may be controlled by variously changing the width, the interval, the material, or the like, of the first and second spacer parts 61 and 62 to adjust mutual interference between the first and second internal coil parts 41 and 42.

Figure 4:
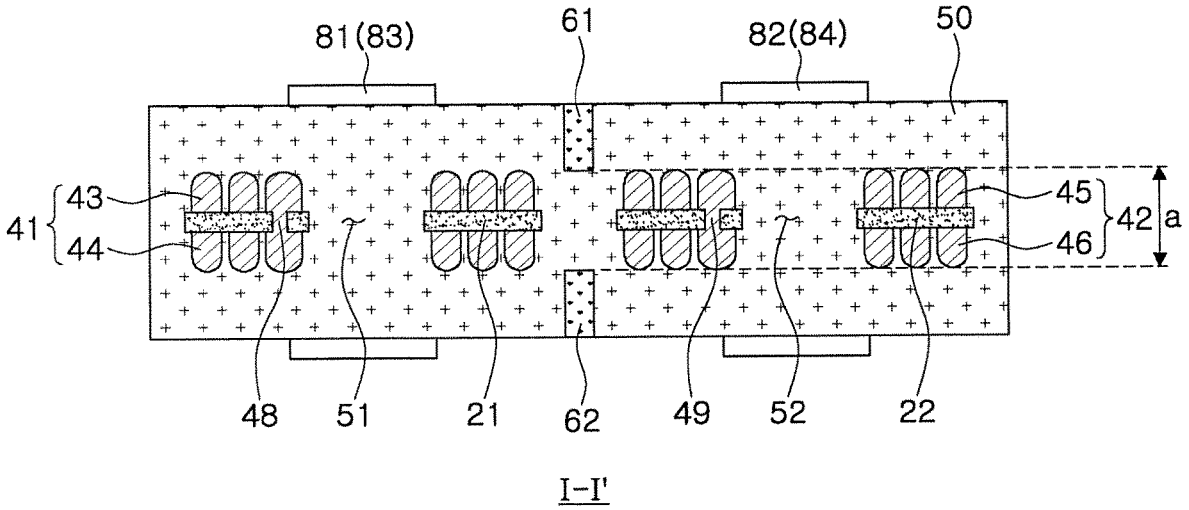
FIG. 4 is a cross-sectional view taken along line I-I' of FIG. 1.

FIG. 4 is a cross-sectional view taken along line I-I' of FIG. 1.

Referring to FIG. 4, the first coil conductors 43 and 45 disposed on the first surfaces of the first and second support members 21 and 22 and the second coil conductors 44 and 46 disposed on the second surfaces of the first and second support members 21 and 22 may be connected to each other by vias 48 and 49 penetrating through the first and second support members 21 and 22.

The first and second spacer parts 61 and 62 disposed between the first and second internal coil parts 41 and 42 may be formed in the upper and lower portions of the magnetic body 50 in the thickness (T) direction to be spaced apart from each other.

An interval a between the first and second spacer parts 61 and 62 may satisfy $0\ \mu m < a < 1000\ \mu m$.

When the interval a between the first and second spacer parts 61 and 62 is 0 μm, that is, the first and second spacer parts and 62 are connected to each other, inductance may be deteriorated, and strength of the magnetic body may be decreased due to the spacer parts When the interval a is greater than 1000 μm, malfunctioning of a product may occur and efficiency may be deteriorated due to harmful mutual interference of the magnetic fields generated by the first and second internal coil parts 41 and 42.

Mutual interference between the first and second internal coil parts 41 and 42 may be adjusted and a coupling value may be controlled by adjusting the interval a between the first and second spacer parts 61 and 62.

That is, a space between the first and second spacer parts 61 and 62 may include a material which is the same as that of the magnetic body 50.

For example, when the magnetic body 50 includes the magnetic metal powder which is dispersed in a thermosetting resin, the space between the first and second spacer parts 61 and 62 may also include the magnetic metal powder which is dispersed in the thermosetting resin.

Figure 5A:
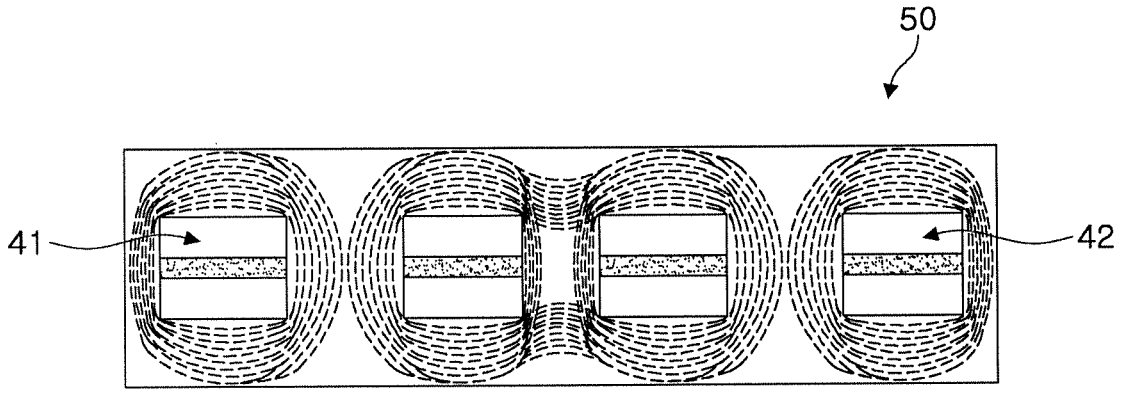
PRIOR ART FIG. 5A
FIG. 5A is a diagram illustrating magnetic fields formed in an electronic component according to the related art in which a spacer part is not provided.
Figure 5B:
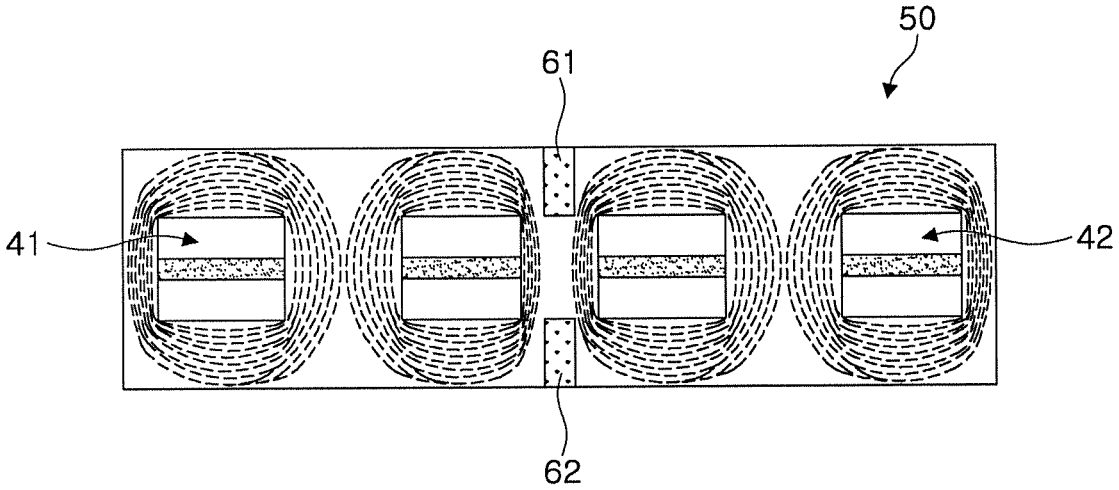
FIG. 5B is a diagram illustrating magnetic fields formed in an electronic component according to an exemplary embodiment in the present disclosure.

FIG. 5A is a diagram illustrating magnetic fields formed in an electronic component according to the related art in which a spacer part is not disposed, and FIG. 5B is a diagram illustrating magnetic fields formed in the electronic component according to the exemplary embodiment in the present disclosure.

Referring to FIG. 5A, in a case of the electronic component in which the spacer part is not disposed, it can be seen that mutual inference of the magnetic fields occurs between the first and second internal coil parts 41 and 42.

On the contrary, referring to FIG. 5B, it can be seen that the first and second spacer parts 61 and 62 are disposed between the first and second internal coil parts 41 and 42, such that mutual interference of the magnetic fields between the first and second internal coil parts 41 and 42 may be suppressed.

Board Having Electronic Component

Figure 6:
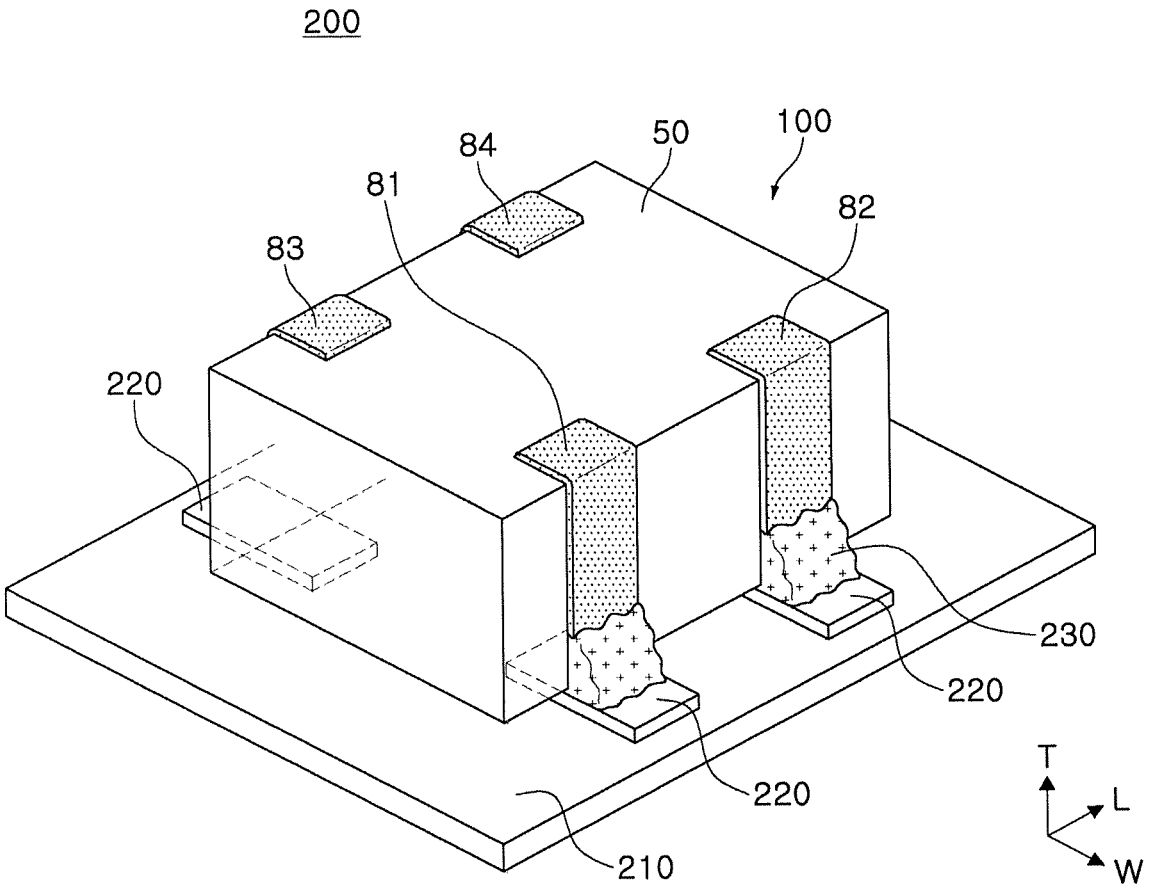
FIG. 6 is a perspective view of a board in which the electronic component of FIG. 1 is mounted on a printed circuit board (PCB).

FIG. 6 is a perspective view of a board in which the electronic component of FIG. 1 is mounted on a printed circuit board (PCB).

Referring to FIG. 6, a board 200 having an electronic component 100 according to the present exemplary embodiment may include a printed circuit board 210 on which the electronic component 100 is mounted and a plurality of electrode pads 220 formed on the printed circuit board 210 to be spaced apart from each other.

The first to fourth external electrodes 81 to 84 disposed on the external surfaces of the electronic component 100 may be electrically connected to the printed circuit board 210 by solders 230 in a state in which the first to fourth external electrodes 81 to 84 are positioned to contact the electrode pads 220, respectively.

Except for the description above, descriptions of features overlapping those of the electronic component according to the previous exemplary embodiment will be omitted.

As set forth above, according to exemplary embodiments in the present disclosure, harmful mutual interference of the magnetic fields generated by the plurality of internal coil parts disposed in the electronic component may be suppressed.

Further, the coupling value may be controlled by adjusting mutual interference between the internal coil parts.

While exemplary embodiments have been shown and described above, it will be apparent to those skilled in the art that modifications and variations could be made without departing from the scope of the present invention as defined by the appended claims.

What is claimed is:

1. An electronic component comprising:

a magnetic body;

first and second internal coil parts embedded in the magnetic body, spaced apart from each other, and including coil conductors disposed on first and second surfaces of each of first and second support members, respectively; and first and second spacer parts disposed between the first and second internal coil parts in upper and lower portions of the magnetic body, respectively, with an interval therebetween, wherein each of the first and second spacer parts has a magnetic permeability lower than that of the magnetic body, the first and second spacer parts are spaced apart from each other in a first direction parallel to winding axes of the first and second internal coil parts, the magnetic body comprises a first cover part enclosing the first internal coil part and the first support member therein, a second cover part enclosing the second internal coil part and the second support member therein, and a connection part disposed between the first and second cover parts and connecting the first and second cover parts to each other, and the connection part of the magnetic body fills a space between the first and second spacer parts and a space between the first and second cover parts, the first and second internal coil parts are spaced apart from each other in a second direction perpendicular to the first direction, and each of the first and second spacer parts extends from a first side surface of the magnetic body to a second side surface thereof, the first and second side surfaces opposing each other in a third direction perpendicular to each of the first and second directions.

2. The electronic component of claim 1, wherein the first and second spacer parts contain at least one selected from the group consisting of a thermosetting resin, magnetic metal powder, ferrite, and a dielectric material.

3. The electronic component of claim 1, wherein the first and second spacer parts are formed of a material different from a material of the magnetic body.

4. The electronic component of claim 1, wherein the magnetic body contains a magnetic metal powder and a thermosetting resin.

5. The electronic component of claim 1, wherein the coil conductors are electroplated layers.

6. The electronic component of claim 1, wherein the first and second internal coil parts include first and second lead portions exposed to first and second side surfaces of the magnetic body, respectively, the first lead portions are connected to first and second external electrodes disposed on the first side surface of the magnetic body, and the second lead portions are connected to third and fourth external electrodes disposed on the second side surface of the magnetic body.

7. The electronic component of claim 6, wherein the first and second external electrodes are input terminals, and the third and fourth external electrodes are output terminals.

8. An electronic component comprising:

a magnetic body;

first and second internal coil parts embedded in the magnetic body, spaced apart from each other, and including coil conductors disposed on first and second surfaces of each of first and second support members, respectively; and a spacer part disposed between the first and second internal coil parts and suppressing mutual interference of magnetic fields generated by the first and second internal coil parts, wherein the spacer part includes first and second spacer parts disposed in upper and lower portions of the magnetic body, respectively, with an interval therebetween, each of the first and second spacer parts has a magnetic permeability lower than that of the magnetic body, the first and second spacer parts are spaced apart from each other in a first direction parallel to winding axes of the first and second internal coil parts, the magnetic body comprises a first cover part having the first internal coil part and the first support member embedded therein, a second cover part having the second internal coil part and the second support member embedded therein, and a connection part disposed between the first and second cover parts and connecting the first and second cover parts to each other, and the connection part of the magnetic body fills a space between the first and second spacer parts and a space between the first and second cover parts, the first and second internal coil parts are spaced apart from each other in a second direction perpendicular to the first direction, and each of the first and second spacer parts extends from a first side surface of the magnetic body to a second side surface thereof, the first and second side surfaces opposing each other in a third direction perpendicular to each of the first and second directions.

* * * * *